US006217355B1

(12) United States Patent
Charnock

(10) Patent No.: US 6,217,355 B1
(45) Date of Patent: Apr. 17, 2001

(54) COMPRESSED AIR CLOCKSPRING

(75) Inventor: Martin Charnock, Lancashire (GB)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 09/456,108

(22) Filed: Dec. 7, 1999

(51) Int. Cl.[7] ..... H01R 35/04
(52) U.S. Cl. ..... 439/164; 439/191
(58) Field of Search ..... 439/164, 15, 191, 439/192, 194, 195

(56) References Cited

U.S. PATENT DOCUMENTS

| | | | | |
|---|---|---|---|---|
| 5,429,517 | | 7/1995 | Bolen | 439/164 |
| 5,460,535 | | 10/1995 | Bolen | 439/164 |
| 5,487,667 | | 1/1996 | Bolen | 439/164 |
| 5,490,793 | | 2/1996 | Bolen | 439/164 |
| 5,580,259 | | 12/1996 | Bolen et al. | 439/164 |
| 5,601,437 | | 2/1997 | Harvey et al. | 439/15 |
| 5,637,006 | * | 6/1997 | Almeras | 439/191 |
| 5,743,555 | | 4/1998 | Durrani | 280/731 |
| 5,775,920 | | 7/1998 | Henderson | 439/15 |
| 5,785,541 | | 7/1998 | Best et al. | 439/164 |
| 5,865,329 | * | 2/1999 | Gay et al. | 439/195 |
| 5,980,286 | | 11/1999 | Best et al. | 439/164 |

* cited by examiner

*Primary Examiner*—Gary F. Paumen
(74) *Attorney, Agent, or Firm*—Karl D. Kovach; David L. Newman

(57) ABSTRACT

A compressed air clockspring includes a housing and a hub rotatably mounted with the housing. The housing has a first electrical connector and a first pneumatic port. The hub has a second electrical connector and a second pneumatic port. A ribbon cable has one end connected to the first electrical connector of the housing and the other end of the ribbon cable is connected to the second electrical connector of the hub. An air ring is rotatably mounted in the housing. The air ring rotates with the hub. The air ring fluidically connects the first pneumatic port to the second pneumatic port. The ribbon cable transmits electrical signals from the crash sensor to the airbag as is common in present day clocksprings. Unlike present day clocksprings, the compressed air clockspring transmits compressed air through the rotary joint formed by the structure of the compressed air clockspring. Transmission of compressed air through the compressed air clockspring provides the occupant with freshly ventilated air, or the compressed air can be heated and ducted through the steering wheel so as to warm the steering wheel, all-the-while, the compressed air clockspring being ready and capable of simultaneously transmitting electrical signals through the rotary joint.

18 Claims, 3 Drawing Sheets

COMPRESSED AIR CLOCKSPRING

BACKGROUND OF THE INVENTION

1. Field of the Invention

The present invention relates to the transmission of electrical signals and compressed air through a rotary joint or connector. The invention more particularly concerns a rotary connector which takes the form of an automotive clockspring.

2. Discussion of the Background

Clocksprings are well known in the automobile industry. An automotive clockspring is an electrical connector or rotary transducer which electrically connects a rotatable airbag assembly mounted on the steering wheel to stationary crash sensors located elsewhere on the vehicle. An automotive clockspring typically includes a housing and a cover mounted to the housing so as to form a cavity therebetween. Rotatably mounted within the cavity is a hub. The clockspring housing is non-rotatably mounted to the steering column, while the hub is attached to the rotatable airbag assembly. A flat ribbon cable is wound around the hub. One end of the flat ribbon cable terminates at the stationary housing or cover and the other end terminates at the hub. The end of the flat ribbon cable terminated at the hub is then connected to an electrical cable which connects to the airbag assembly. During use, the flat ribbon cable is either spooled or un-spooled around the hub when the steering wheel is rotated in one direction or the other direction. Examples of clocksprings are provided in U.S. Pat. Nos. 5,785,541, 5,601,437, 5,580,259, 5,490,793, 5,487,667, 5,460,535, 5,429,517, 5,980,286, and 5,775,920 all of which are hereby incorporated herein by reference.

Devices other than airbags are also mounted on the steering wheel which receive electrical signals. As the automotive industry has matured, vehicles have become more refined as fueled by consumer requirements. Vehicles that appeal to the consumer-mass-market typically have controls and features which are within an arm's length of the driver. To reduce the amount of effort on the part of the driver and to increase the comfort of the driver, more and more functions, switches, and controls are placed ever closer to the driver. Since the driver's hands are on the steering wheel, automobile manufacturers have been placing electrical switches on the steering wheel so that the driver can activate the electrical switches with one finger while keeping their hands on the steering wheel.

Thus, there is a need for increasing the comfort of drivers of automobiles while the drivers keep their hands on the steering wheel.

SUMMARY OF THE INVENTION

It is an object of the invention to provide a clockspring which can support controls and devices mounted on the steering wheel.

It is a further object of the invention to provide a clockspring which can support controls and devices mounted in the steering wheel.

It is yet another object of the invention to provide a clockspring which provides electrical energy to the steering wheel.

It is still yet another object of the invention to provide a clockspring or rotary connector which provides compressed air or pneumatic energy to the steering wheel.

It is another object of the invention to provide a device which is low in cost to produce.

It is still further another object of the invention to provide a clockspring which is highly reliable.

In one form of the invention the compressed air clockspring includes a housing, a hub, a ribbon cable, and an air ring. The housing has a first electrical connector and a first pneumatic port. The hub has a second electrical connector and a second pneumatic port. The hub is rotatably mounted to the housing. The ribbon cable has a first end and a second end. The first end of the electrical cable is attached to the first electrical connector of the housing, and the second end of the ribbon cable is attached to the second electrical connector of the hub. The air ring is rotatably mounted to the housing. The air ring fluidically connects the first pneumatic port of the housing to the second pneumatic port of the hub.

In yet another form of the invention, the compressed air clockspring includes a housing, a hub, electrical connection means, and fluidic connection means. The housing has a first electrical connector and a first pneumatic port. The hub has a second electrical connector and a second pneumatic port. The hub is rotatably mounted to the housing. The electrical connection means connects the first electrical connector to the second electrical connector. The fluidic connection means connects the first pneumatic port to the second pneumatic port.

In another embodiment, the compressed air clockspring is known as a rotary connector for transmitting compressed air since the device does not include a ribbon cable. The rotary connector includes a housing, a hub, and an air ring. The housing has a first pneumatic port. The hub has a second pneumatic port. The hub is rotatably mounted to the housing, and the hub having an axis of rotation. The air ring is rotatably mounted to the housing. The air ring fluidically connects the first pneumatic port of the housing to the second pneumatic port of the hub. The first pneumatic port being located a first distance away from the axis of rotation, and the second pneumatic port being located a second distance away from the axis of rotation.

Thus, the invention achieves the objectives set forth above. The invention provides a device which conveys both electrical and pneumatic energy through a rotary connector.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PRESENTLY PREFERRED EMBODIMENT

Figure 1:
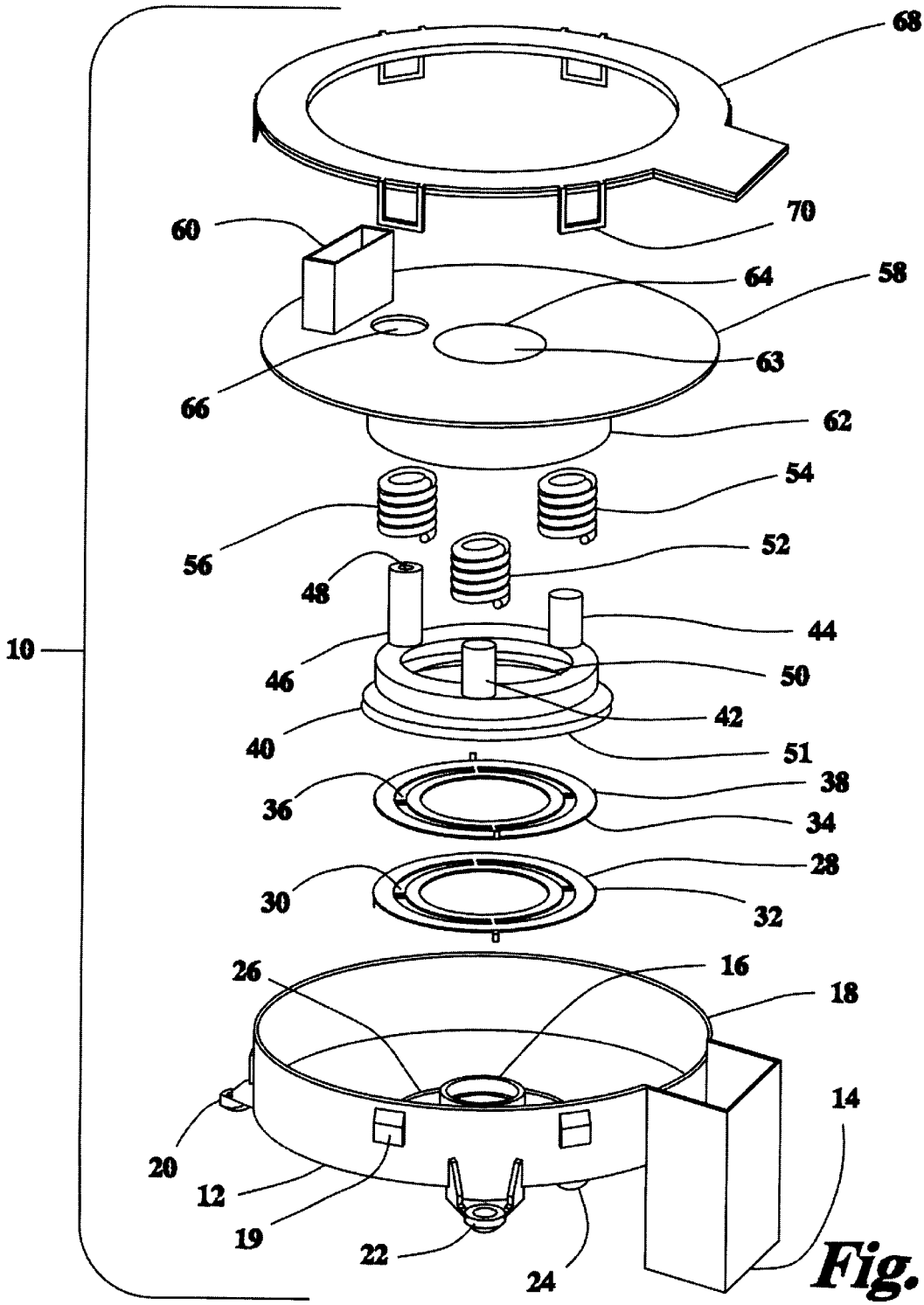
FIG. 1 is an exploded perspective view of the compressed air clockspring.

Referring now to the drawings, wherein like reference numerals designate identical or corresponding parts throughout the several views, and more particularly to FIGS. 1–4 thereof, an embodiment of the present invention is a compressed air clockspring 10 as shown in FIGS. 1–4.

FIG. 1 is an exploded top view of the compressed air clockspring 10. The compressed air clockspring 10 includes a housing 12, a hub 58 rotatably mounted in the housing 12, and a cover 68 retaining the hub 58 within the housing 12. The housing 12 includes an electrical connector 14, an outer wall 18, an inner wall 16, locking features 19, and multiple mounting bosses 20, 22. The bottom of the housing 12 has a pneumatic port 24 (see FIG. 4) which is in fluidic communication with a recess 26. In a preferred embodiment, insert-molded into a bottom of the housing 12 is a slip ring 28. The slip ring 28 has numerous tangs 32 around which material of the housing 12 is insert-molded. The slip ring 28 may also be attached to the housing 12 via other means such as with fasteners or adhesives or compression fit with the recess 26. The slip ring 28 also has a plurality of orifices 30. The pneumatic port 24, recess 26, and the orifices 30 of the slip ring 28 are in fluidic communication with each other.

Figure 2:
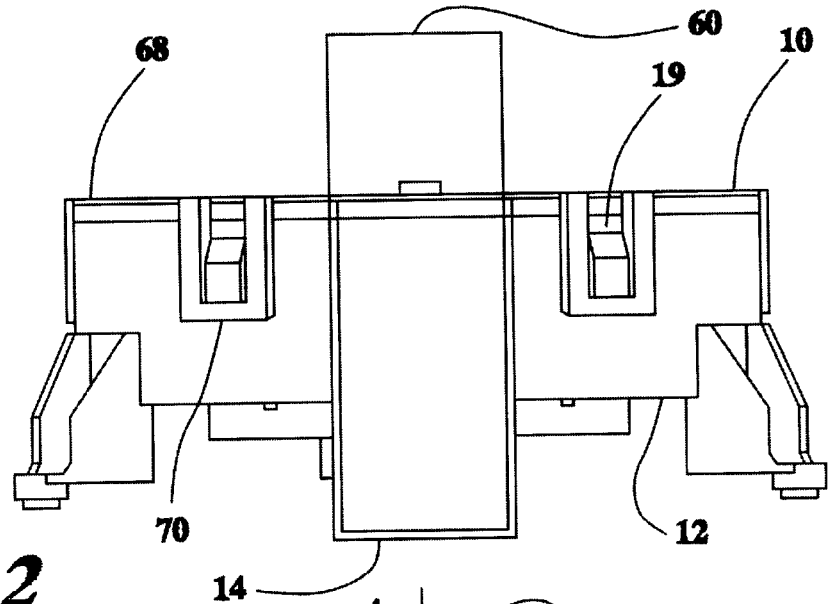
FIG. 2 is a side view of the assembled compressed air clockspring of FIG. 1.

The cover 68 includes multiple locking latches 70 which are complementary to the locking features 19 of the housing 12 (as shown in FIG. 2).

Figure 4:
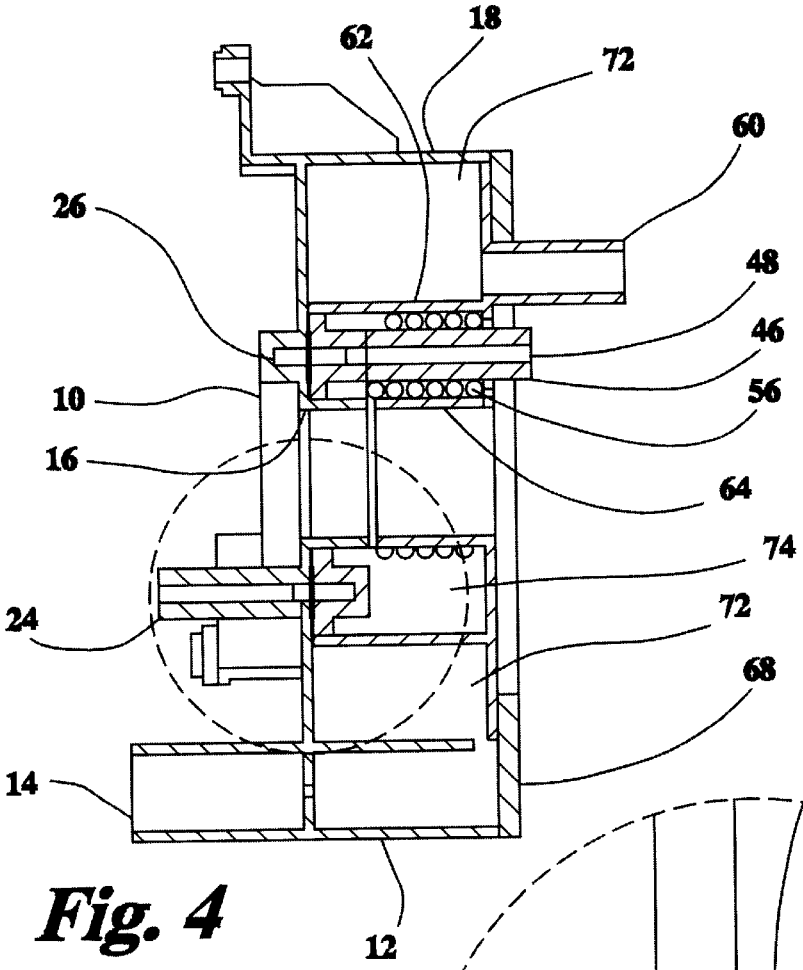
FIGS. 4 and 4A are cross-sectional views of the compressed air clockspring taken along section line 4—4 of FIG. 3.

The hub 58 includes an electrical connector 60, an outer wall 62, an aperture 63, an inner wall 64, and a pneumatic port 66. When the hub 58 is rotatably mounted within the housing 12, the resulting structure creates an inner annulus 74, and an outer annulus 72, as shown in FIG. 4. The ribbon cable (not shown) is wound within the outer annulus 72. The ribbon cable is typically a flat cable having multiple copper conductors enclosed within insulating layers. One end of the ribbon cable terminates at the electrical connector 14 of the housing 12, and the other end of the ribbon cable terminates at the electrical connector 60 of the hub 58. The ribbon cable is simply wound around the outer wall 62 of the hub 58 and either becomes further wound or unwound depending on the relative rotation between the hub 58 and the housing 12. Held within the inner annulus 74 is an air ring 40 and springs 52, 54, 56.

The air ring 40 includes a recess 41 (see FIG. 4), spring supports 42, 44, and an air pipe 46, an inner rim 50, and an outer rim 51. The air pipe 46 includes an aperture 48. The aperture 48 is in fluidic communication with the recess 41. Attached to the air ring 40 is a slip ring 34. The slip ring 34 has a plurality of orifices 36, and multiple tangs 38. In a preferred embodiment, the material of the air ring 40 is insert-molded around the tangs 38 of the slip ring 34 so as to create an integral assembly. The spring supports 42, 44 and the air pipe 46 are surrounded by springs 52, 54, 56 in order to provide a tensile force between the housing 12 and the hub 58, when the springs 52, 54, 56 are in a state of compression. Other tensile means known in the art may be used in place of the springs 52, 54, 56.

Figure 3:
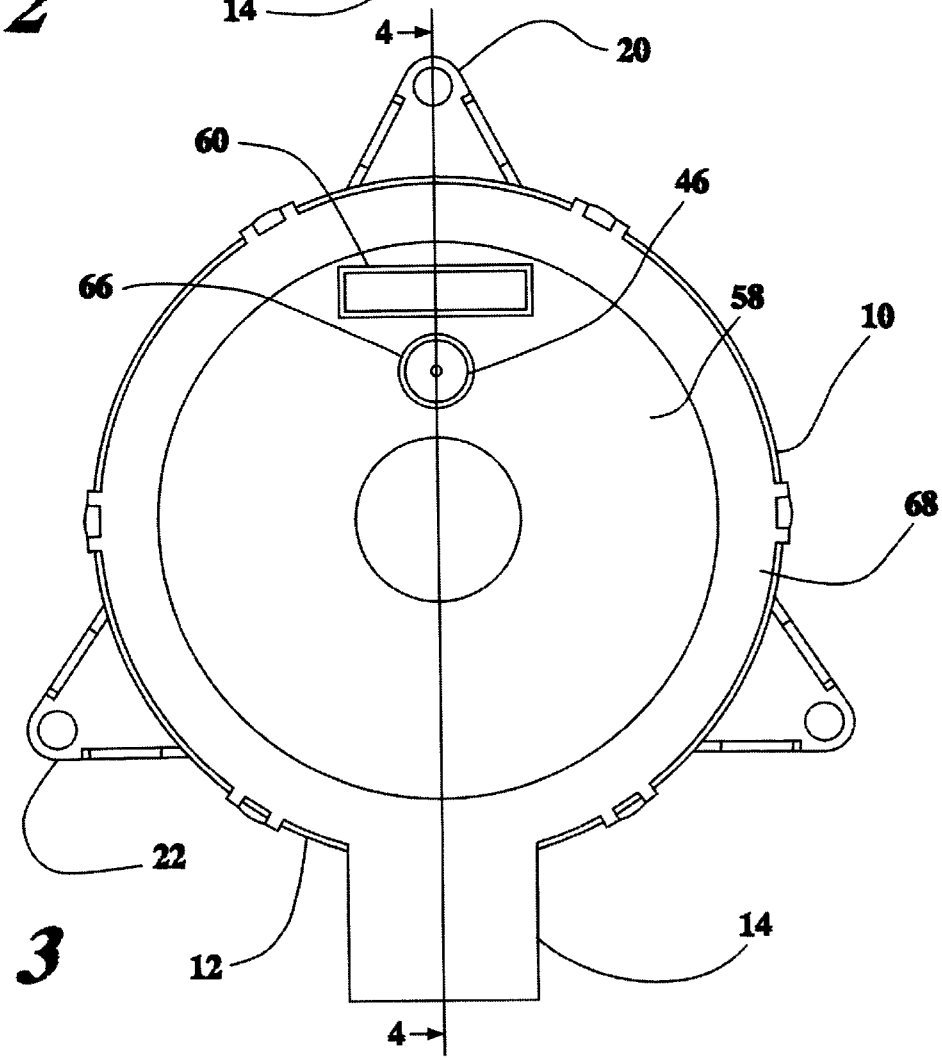
FIG. 3 is a top view of the compressed air clockspring of FIG. 2.

As shown in FIGS. 1 and 3, the air ring 40 is retained in the radial direction by the inner wall 16 of the housing 12 and by the outer wall 62 of the hub 58. Furthermore, the air ring 40 rotates in unison with the hub 58, since the air pipe 46 of the air ring 40 extends through the pneumatic port 66 of the hub 58.

During assembly, the springs 52, 54, 56 are slipped over the respective spring support 42, 44 and the air pipe 46. Then the air ring 40 containing the springs 52, 54 56 are placed within the inner annulus 74 of the hub 58 so that air pipe 46 protrudes through the pneumatic port 66 of the hub 58. The height of the springs 52, 54, 56, in a free state, is greater than a height of the inner annulus 74, thus, once assembled, the springs 52, 54, 56 are in a state of compression. The force generated by the compressed springs 52, 54, 56 urge the two slip rings 28, 34 towards each other so as to produce an effective seal at that location. One spring or more than three springs can be used to provide the sealing force. Three springs are shown since the combination of three springs prevents the air ring 40 and the hub 58 from being skewed by an unbalanced force. That is, the three springs each, individually, produce a force the sum of which results in a force which is nearly co-axial with the rotational axis of the hub 58. The ribbon cable is then attached at one end with the electrical connector 14 of the housing 12 and the other end of the ribbon cable is then connected to the electrical connector 60 of the hub 58 with the remaining amount of the ribbon cable wound about the region of the outer annulus 72 of the hub 58 while the hub 58 is inserted into the housing 12. Thereafater, the cover 68 is placed over the assembled parts and retains those parts within the housing 12.

FIG. 2 shows the attachment of the locking latches 70 of the cover 68 with the complementary features of the locking features 19 of the housing 12. FIG. 2 also shows the electrical connectors 14, 60. Once the unit is assembled, the locking features 19 and the locking latches 70 can be welded together. Furthermore, during assembly grease is placed between the slip rings 28, 34, so as to accommodate the relative rotation between the slip rings 28, 34.

FIG. 3 is a top view of the compressed air clockspring 10. FIG. 3 shows details of the mounting bosses 20, 22, the air pipe 46, the pneumatic port 66 of the hub 58, electrical connector 60, electrical connector 14, and the aperture 63 of the hub 58.

Figure 4A:
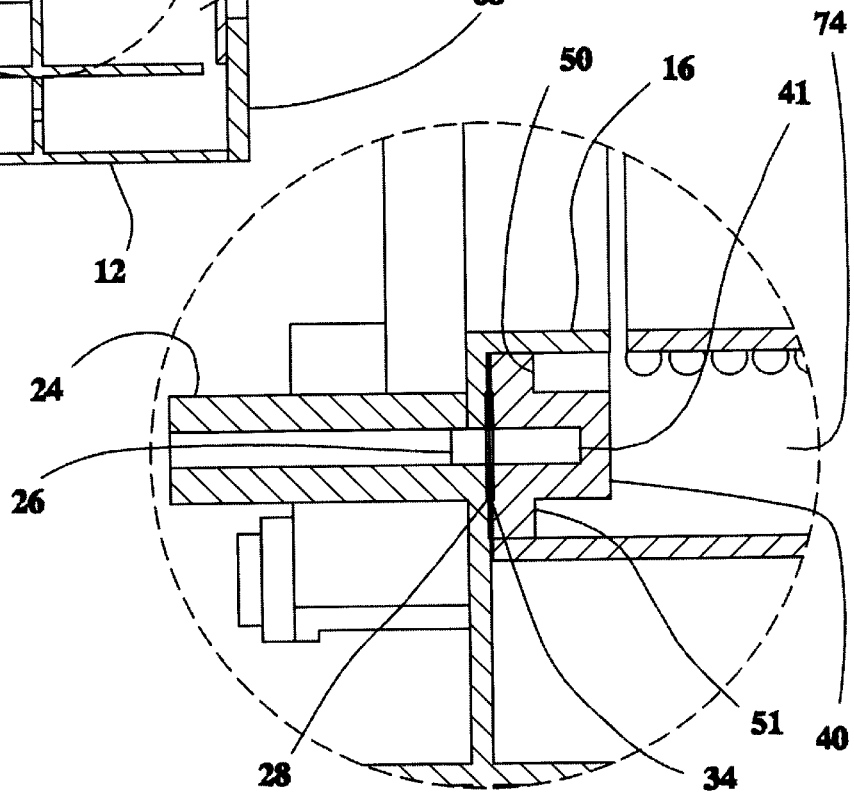

FIGS. 4 and 4A are cross-sectional views of the compressed air clockspring 10 taken along section line 4—4 of FIG. 3. FIG. 4 shows the placement of a representative spring (such as spring 52) in the inner annulus 74. For reasons of clarity the ribbon cable is not shown in the outer annulus 72. FIG. 4 makes evident the fluidic communication between the pneumatic port 24 of the housing 12, the recess 26 of the housing 12, and the recess 41 of the air ring 40. FIG. 4A is an enlarged view of the slips rings of FIG. 4.

In operation, the electrical portion of the compressed air clockspring 10 operates similarly to clocksprings of previous designs that were mentioned previously and incorporated herein by reference and will not be discussed further. The compressed air portion of the compressed air clockspring 10 includes the introduction of compressed air into the pneumatic port 24 of the housing 12. The compressed air then flows into the recess 26 of the housing 12. From there the compressed air flows in the orifices 30 of the slip ring 28. The compressed air then continues on to the orifices 36 of the slip ring 34. Little or no compressed air escapes in the region between the slip rings 28, 34, since the springs 52, 54, 56 are in a state of compression and urge the air ring 40 which contains the slip ring 38 toward the slip ring 28. The compressed air is then introduced into the recess 41 of the air ring 40. Then the compressed air is finally transmitted into the aperture 48 of the air pipe 46 of the air ring 40 and can then be transmitted to a device on the steering wheel. Since the air pipe 46 passes through the pneumatic port 66 of the hub 58, the compressed air also passes through the pneumatic port 66. However, the air ring 40 can be modified so that the air pipe 46 does not pass through the pneumatic port 66. In such an embodiment, the air pipe 46 attaches to the pneumatic port 66 from within the inner annulus 74. The orientation of the orifices 30, 36 ensure that there is a free flow of compressed air between the housing 12 and the air ring 40 depending on the size and number of the orifices 30, 36 regardless of the relative rotation of the hub 58 and the housing 12.

In a preferred embodiment, the housing 12, the hub 58, the cover 68, and the air ring 40 are preferably made of a polymer material. The springs 52, 54, and 56 are typically made of a metallic compound. The slip rings 28, 34, are preferably made of brass.

Thus, the device can supply warm air to the steering wheel so as to warm the hands of the driver, or the compressed air can be used to provide ventilation to the driver. Furthermore, the compressed air can be used for other purposes.

Furthermore, in another embodiment, the compressed air clockspring can be used without the ribbon cable. Such a device is a rotary connector for transmitting compressed air. The rotary connector for transmitting compressed air is not shown.

Obviously, numerous modifications and variations of the present invention are possible in light of the above teachings. It is therefore to be understood that within the scope of the appended claims, the invention may be practiced otherwise than as specifically described herein.

What is claimed is:

1. A compressed air clockspring comprising:

a housing having a first electrical connector and a first pneumatic port;

a hub having a second electrical connector and a second pneumatic port, the hub rotatably mounted to the housing;

a ribbon cable having a first end and a second end, the first end connected to the first electrical connector of the housing, and the second end connected to the second electrical connector of the hub; and an air ring rotatably mounted in the housing, the air ring fluidically connecting the first pneumatic port to the second pneumatic port.

2. The compressed air clockspring according claim 1 wherein the air ring is connected to the hub.

3. The compressed air clockspring according to claim 2 wherein the housing includes a recess in fluidic communication with the first pneumatic port.

4. The compressed air clockspring according to claim 3 wherein the air ring includes an air pipe, the air pipe having an aperture for transmitting the compressed air.

5. The compressed air clockspring according to claim 4 wherein the air ring includes a recess in fluidic communication with the aperture of the air ring.

6. The compressed air clockspring according to claim 5, further comprising a first slip ring connected to the housing, the first slip ring having orifices in fluidic communication with the first pneumatic port.

7. The compressed air clockspring according to claim 6, further comprising a second slip ring connected to the air ring, the second slip ring having orifices in fluidic communication with the recess of the of the air ring.

8. The compressed air clockspring according to claim 7 wherein the air pipe of the air ring protrudes through the second pneumatic port of the hub.

9. The compressed air clockspring according to claim 8 wherein the air ring includes spring supports.

10. The compressed air clockspring according to claim 9, further comprising springs mounted about the spring supports, the springs being compressed and imparting a force so as to urge the first and second slip rings toward each other.

11. The compressed air clockspring according to claim 10, further comprising a cover attached to the housing.

12. The compressed air clockspring according to claim 11 wherein the cover includes locking latches.

13. The compressed air clockspring according to claim 12 wherein the housing includes locking features, the locking features being complementary and interlocking with the locking latches of the cover when the cover is attached to the housing.

14. The compressed air clockspring according to claim 13 wherein the housing further includes mounting bosses.

15. The compressed air clockspring according to claim 14 wherein the housing is made of a polymer material, and wherein the hub is made of a polymer material, and wherein the cover is made of a polymer material, and wherein the air ring is made of a polymer material.

16. The compressed air clockspring according to claim 15 wherein the first and second slip rings are made of a brass material.

17. The compressed air clockspring according to claim 16, further comprising grease located between the first and second slip rings.

18. The compressed air clockspring according to claim 17 wherein the hub has an axis of rotation, and wherein the first pneumatic port is located a first distance away from the axis of rotation, and wherein the second pneumatic port is located a second distance away from the axis of rotation.

* * * * *